US007442018B2

(12) United States Patent
Kiyokawa et al.

(10) Patent No.: US 7,442,018 B2
(45) Date of Patent: Oct. 28, 2008

(54) COMPRESSOR HAVING AN OIL RESIDUE POOL

(75) Inventors: Yasunori Kiyokawa, Gunma-ken (JP); Kenji Aida, Gunma-ken (JP); Kazuyoshi Sugimoto, Gunma-ken (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 0 days.

(21) Appl. No.: 11/523,379

(22) Filed: Sep. 19, 2006

(65) Prior Publication Data

US 2007/0065306 A1 Mar. 22, 2007

(30) Foreign Application Priority Data

Sep. 20, 2005 (JP) ..... 2005-272542

(51) Int. Cl.
*F03C 2/00* (2006.01)
*F04C 2/00* (2006.01)

(52) U.S. Cl. ..... 418/88; 418/94; 418/55.1; 418/55.6; 184/6.16

(58) Field of Classification Search ..... 418/88, 418/55.1–55.6, 57, 210, 66; 184/6.16
See application file for complete search history.

(56) References Cited

U.S. PATENT DOCUMENTS 5,810,573 A * 9/1998 Mitsunaga et al. ..... 418/55.6
6,012,911 A * 1/2000 Hirooka et al. ..... 418/88

FOREIGN PATENT DOCUMENTS

| | | | |
|---|---|---|---|
| GB | 1234889 | * | 6/1971 |
| JP | A 5-65884 | | 3/1993 |
| JP | A 6-26469 | | 2/1994 |
| JP | 08177773 A | * | 7/1996 |
| JP | A 9-32760 | | 2/1997 |
| JP | 10018980 A | * | 1/1998 |
| JP | 2003148370 A | * | 5/2003 |

* cited by examiner

*Primary Examiner*—Theresa Trieu
(74) *Attorney, Agent, or Firm*—Weingarten, Schurgin, Gagnebin & Lebovici LLP

(57) ABSTRACT

A compressor comprises, in a container body, an electric element, and a compressive element driven by the electric element. An oil storage is provided in the bottom, and an oil pump is provided to suck up oil from the oil storage. The oil pump includes a cylinder fixed to a lower support frame, a rotator axially installed on the lower end of a driveshaft and operative to rotate within an inner space of the cylinder, and a suction pipe having an upper end connected to a communication notch formed in the cylinder and a lower end inserted and arranged in the oil storage. In this compressor, the upper end of the suction pipe is protruded into the communication notch of the cylinder to configure an oil residue pool.

3 Claims, 4 Drawing Sheets

COMPRESSOR HAVING AN OIL RESIDUE POOL

This application claims priority to Japanese application No. 2005-272542 filed Sep. 20, 2005.

BACKGROUND OF THE INVENTION

1. Field of the Invention

The present invention relates to a compressor, and more particularly to a compressor including an oil residue pool provided, in an oil pump that sucks up oil from an oil storage in the bottom, to allow part of return oil to reside in the pool when the compressor stops.

2. Description of the Related Art

In general, known compressors for use in compression of gases may be of the reciprocation type, the rotary type and the scroll type. These compressors comprise an electric element including an electric motor, and a compressive element driven by the electric element. They are operative to compress a gas such as a refrigerant gas led into the compressive element and discharge the compressed gas, which is fed to an air conditioner, a refrigerator, or a freezer/refrigerator in a freezing cycle.

The compressors of such the types generally include an oil storage to store lubricant oil in the bottom of a container that configures a compressor body. An oil pump is attached to the lower end of a driveshaft axially installed on the rotor of the electric element. This oil pump is operative to suck up the oil from the oil storage and supply the oil to a sliding portion of the compressive element and a bearing portion of the driveshaft for lubrication through an oil passage provided in the driveshaft along the axial line. The oil once used in lubrication is fed back to the oil storage and reused repeatedly in this structure (see Patent Document 1 (JP-A 6-26469), Patent Document 2 (JP-A 9-32760), and Patent Document 3 (JP-A 5-65884), for example).

There is another oil pump structured as shown in FIG. 6(*a*). This oil pump comprises a support frame A attached to a compressor container. Together with an attachment member B, a cylinder D is fixed to the support frame A using a bolt C. A driveshaft E is axially installed on a rotor of an electric element (not shown). A rotator G is axially installed on the lower end of the driveshaft E via a pin F and operative to rotate within an inner space Da of the cylinder D. A suction pipe I is provided, which has an upper end connected to a communication notch H formed by notching part of the cylinder D, and the other end inserted and arranged in an oil storage (not shown) provided in the container bottom.

The cylinder D of this oil pump is provided with plates J, K located in the upper and lower surfaces thereof to close the upper and lower surfaces of the inner space Da. In addition, the cylinder is attached such that the center of the inner space Da is slightly deviated W from the center of the rotator G to form an eccentric annular oil passage between the cylinder and the rotator G as shown in FIG. 6(*b*). This oil passage is brought into communication with the communication notch H and a communication path Ba formed in the upper surface of the attachment member B as shown in FIG. 6(*a*). The communication path Ba is brought into communication with an axial bore Ga formed through the center of the rotator G. A notch Gb is provided in the outer circumference of the rotator G. A columnar piston member L is slidably fitted in the notch Gb.

In the oil pump thus configured, when the driveshaft E rotates about the axis, the rotator G rotates within the inner space Da of the cylinder D. As a result, a suction force is caused in the communication notch H and it sucks up the oil from the oil storage through the suction pipe I. The oil sucked up through the suction pipe I is sucked from the communication notch H into the inner space Da of the cylinder D. In addition, the oil pushed by the piston member L moves through the eccentric annular oil passage and flows into the communication path Ba of the attachment member B. Then the oil moves upward from the communication path Ba along the inner wall of the axial bore Ga in the rotator G. It further moves upward along the inner wall of the oil passage Ea provided inside the driveshaft E and is supplied to the sliding portion of the compressive element and the bearing portion of the driveshaft E.

In the above conventional oil pump, a centrifugal force caused from the rotation of the driveshaft E about the axis makes the oil move upward along the inner wall of the oil passage Ea. The oil is then supplied from the oil supply hole provided in communication with the oil passage Ea to the sliding portion of the compressive element and the bearing portion of the driveshaft. When the compressor stops, the centrifugal force caused by the driveshaft E is lost and the oil in the oil passage Ea moves downward along the inner wall. Under pressure of the oil moving downward, the oil flows backward through the flow path in the oil pump and drops from the communication notch H through the suction pipe I into the oil storage. Therefore, when the compressor stops, the oil is hardly allowed to reside in the oil pump. This causes a problem because the oil supply performance of the oil pump is lowered when the compressor restarts.

SUMMARY OF THE INVENTION

The present has been made to solve such the conventional problem and has an object to provide a compressor. This compressor is configured such that part of return oil is allowed to reside in an oil pump when the compressor stops, thereby enhancing the oil supply performance of the oil pump when the compressor restarts.

To achieve the above object, in a first aspect the invention provides a compressor, comprising: a container; an electric element provided in the container; a compressive element driven by the electric element; an oil storage provided in the bottom of the container; an oil pump provided to suck up oil from the oil storage, the oil pump including a cylinder fixed to a support frame attached in the container, a rotator attached to the lower end of a driveshaft axially installed on the rotor of the electric element and operative to rotate within an inner space of the cylinder, and a suction pipe having an upper end connected to a communication notch formed in the cylinder and a lower end inserted and arranged in the oil storage; and an oil residue pool provided in the communication notch of the cylinder.

In a second aspect of the invention, the oil residue pool is configured such that the upper end of the suction pipe is projected into and attached to the communication notch of the cylinder.

In a third aspect of the invention, the oil residue pool is configured such that a standing wall is provided in the communication notch of the cylinder, and a higher oil passage is provided above the standing wall, wherein the oil passage at the suction pipe is brought into communication with the oil passage at the inner space of the cylinder through the higher oil passage.

In a fourth aspect of the invention, the oil residue pool is configured such that the lower end of the communication notch of the cylinder is connected to the upper end of the suction pipe, wherein an enlarged diameter portion is provided at the upper end of the suction pipe, wherein a float is housed in the enlarged diameter portion.

In the first aspect of the invention, the oil pump attached to the lower end of the driveshaft sucks up oil from the oil storage and supplies the oil for lubrication to the sliding portion of the compressive element and the bearing portion of the driveshaft. This compressor comprises the oil residue pool, which is provided in the communication notch formed in the cylinder, or a component of the oil pump. Accordingly, part of the oil returning to the oil storage is allowed to reside in the oil pump when the compressor stops. Thus, oil remains in the oil pump when the compressor restarts. Accordingly, the property of sealing the oil pump can be enhanced and the oil supply performance of the oil pump can be improved.

In the second aspect of the invention, the oil residue pool is configured such that the upper end of the suction pipe is projected into and attached to the communication notch of the cylinder. Accordingly, the oil flowing from the communication notch of the cylinder into the suction pipe and returning to the oil storage when the compressor stops can be blocked to flow at the protruded upper end of the suction pipe when the remainder reduces. Thus, part of oil is forced to reside in the oil pump.

In the third aspect of the invention, the oil residue pool is configured such that a standing wall is provided in the communication notch of the cylinder, and a higher oil passage is provided above the standing wall. In this case, the oil passage at the suction pipe is brought into communication with the oil passage at the inner space of the cylinder through the higher oil passage. Accordingly, the oil flowing from the communication notch of the cylinder into the suction pipe and returning to the oil storage when the compressor stops can be blocked to flow at the higher oil passage above the standing wall when the remainder reduces. Thus, part of oil is forced to reside in the oil pump.

In the fourth aspect of the invention, the oil residue pool is configured such that the lower end of the communication notch of the cylinder is connected to the upper end of the suction pipe. In this case, an enlarged diameter portion is provided at the upper end of the suction pipe, and a float is housed in the enlarged diameter portion. Accordingly, the float closes the suction pipe if the amount of return oil reduces when the compressor stops. Thus, the oil returning to the oil storage is blocked to flow by the float at the upper end of the suction pipe such that part of oil is forced to reside in the oil pump.

DETAILED DESCRIPTION OF THE INVENTION

Embodiments of the present invention applied to the scroll compressor will be described next.

Figure 1:
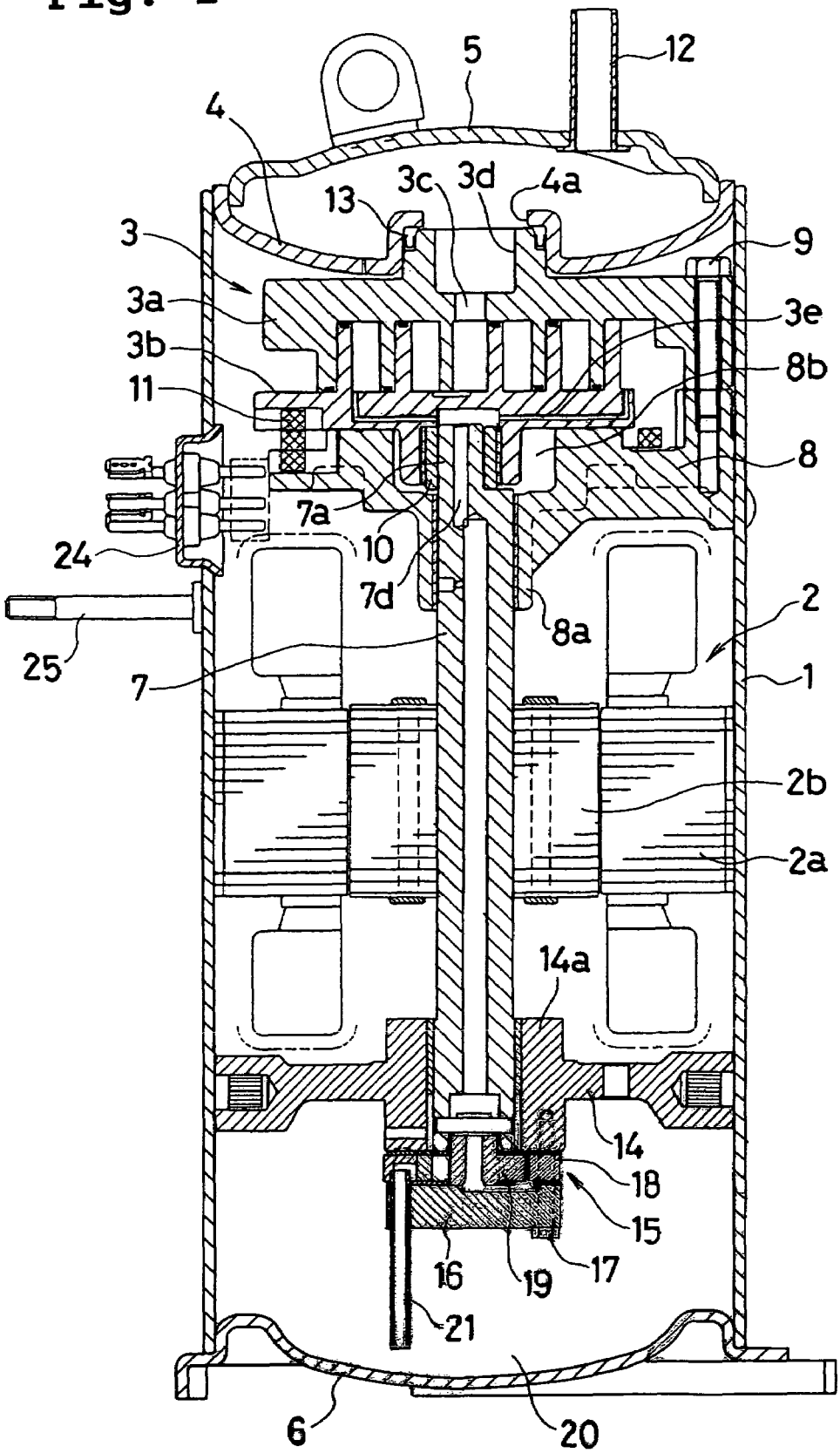
FIG. 1 is a brief vertical cross-sectional view showing a first embodiment of the present invention applied to the scroll compressor.

FIG. 1 is a brief vertical cross-sectional view showing a first embodiment of the present invention. In the figure, the reference numeral 1 denotes a cylindrical container body, which houses an electric element 2 and a compressive element 3 driven by the electric element 2 as arranged in the body. An upper cap 5 is attached to the upper end of the container body 1 with a partition disc 4 interposed therebetween. A lower cap 6 is attached to the lower end of the container body 1 to configure a hermetic container.

The electric element 2 is an electric motor, which includes a stator 2*a* having an outer circumferential portion fixed on the inner wall of the container body 1 almost at the central portion, and a rotor 2*b* rotatably disposed on the central portion of the stator 2*a*. A drive shaft 7 is inserted through and axially installed on the central portion of the rotor 2*b*.

The compressive element 3 is of the publicly known scroll type, which includes a fixed scroll 3*a* having a swirling recess on the almost disc-like lower surface, and a swinging scroll 3*b* having a swirling protrusion on the almost disc-like upper surface. The swirling recess and protrusion of these paired scrolls are combined to form a compression chamber for use in compressive actions. In a word, the fixed scroll 3*a* is kept stationary while the swinging scroll 3*b* is controlled not to rotate but to turn about the central axis thereof. As a result, the compression chamber formed of the above swirling recess and protrusion rotates in response to turns of the swinging scroll 3*b* and shifts to the central portion to gradually reduce the volume thereof. In this case, a gas sucked from external into the compressive element 3 is pressurized in accordance with the equal entropy variation by the volumetric variation associated with the movement of the compression chamber.

An upper support frame 8 is fixed on the upper inner wall of the container body 1. On the upper outer circumferential portion of the upper support frame 8, the fixed scroll 3*a* is secured via a bolt 9 (only one piece is depicted though plural pieces are employed in practice). Through a bearing portion 8*a* formed at the central portion, the upper end of the driveshaft 7 is axially passed and supported. A circular recess 8*b* is formed at the central portion in the upper surface of the upper support frame 8. The driveshaft 7 passed through the bearing portion 8*a* has an eccentric cum 7*a*, which is protruded into the recess 8*b*. The swinging scroll 3*b* has a protruded cylindrical portion in the lower surface, which is fitted into the eccentric cum 7*a*via a bearing 10. Thus, the swinging scroll 3*b* is combined with the fixed scroll 3*a*. The upper support frame 8 and the swinging scroll 3*b* are jointed through an old ham ring 11 to restrict rotations of the swinging scroll. As a result, the eccentric cum 7*a* rotates eccentrically in response to rotations of the driveshaft 7 about the axis, and the eccentric cum 7*a* causes the swinging scroll 3*b* not to rotate but to turn relative to the fixed scroll 3*a*.

The partition disc 4 has a hole 4*a* provided through the central portion. The through hole 4*a* is brought in communication with a discharge port 3*c* provided at the central portion of the fixed scroll 3*a*, and a recess 3*d* located adjacent to the discharge port 3*c*. As a result, the gas compressed at the compressive element 3 is discharged from the discharge port 3*a* of the fixed scroll 3*a*. After flowing through the recess 3*d* and the through hole 4*a* into the upper spatial region partitioned with the partition disc 4, the gas is discharged to external through a discharge pipe 12 attached to the upper cap 5. A seal material 13 is installed on an attachment portion between the central portion of the partition disc 4 and the cylindrical portion formed in the upper surface of the fixed scroll 3*a*. This seal prevents the compressed high-pressure gas led to the upper spatial region (high-pressure region) from leaking to the lower spatial region (low-pressure region) located below the partition disc 4. A pressure open/close valve (not shown) is attached to the recess 3*d* to open/close the discharge port 3*c*.

A lower support frame 14 is fixed on the lower inner wall of the container body 1. The lower support frame 14 has a bearing portion 14*a* formed in the central portion, on which the lower end of the driveshaft 7 is axially installed. An oil pump 15 is attached to the lower surface of the lower support frame 14.

Figure 2:
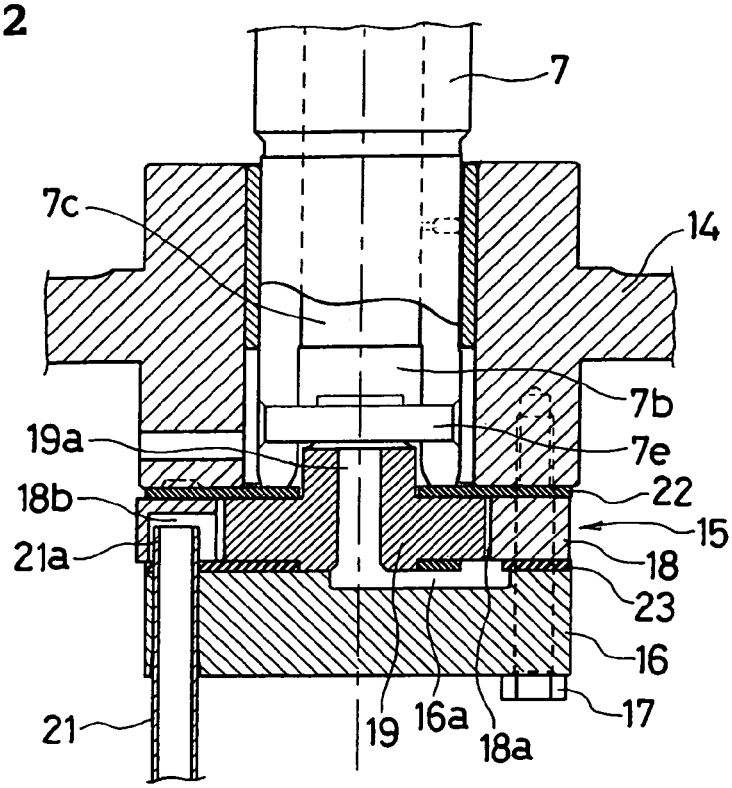
FIG. 2 is a brief enlarged view of part in FIG. 1.

The oil pump 15 includes, as shown in FIG. 2, a cylinder 18 fixed together with an attachment member 16 to the lower support frame 14 using a bolt 17 (only one piece is depicted but plural pieces are used in practice). A rotator 19 is axially installed in a recess 7*b* formed in the lower end of the driveshaft 7 via a pin 7*e* and is operative to rotate within an inner space 18*a* of the cylinder 18. A suction pipe 21 is provided, which has an upper end protruded into and connected to a communication notch 18*b* formed by notching part of the cylinder 18, and a lower end inserted and arranged in an oil storage 20 (FIG. 1) provided in the container bottom.

Figure 6A:
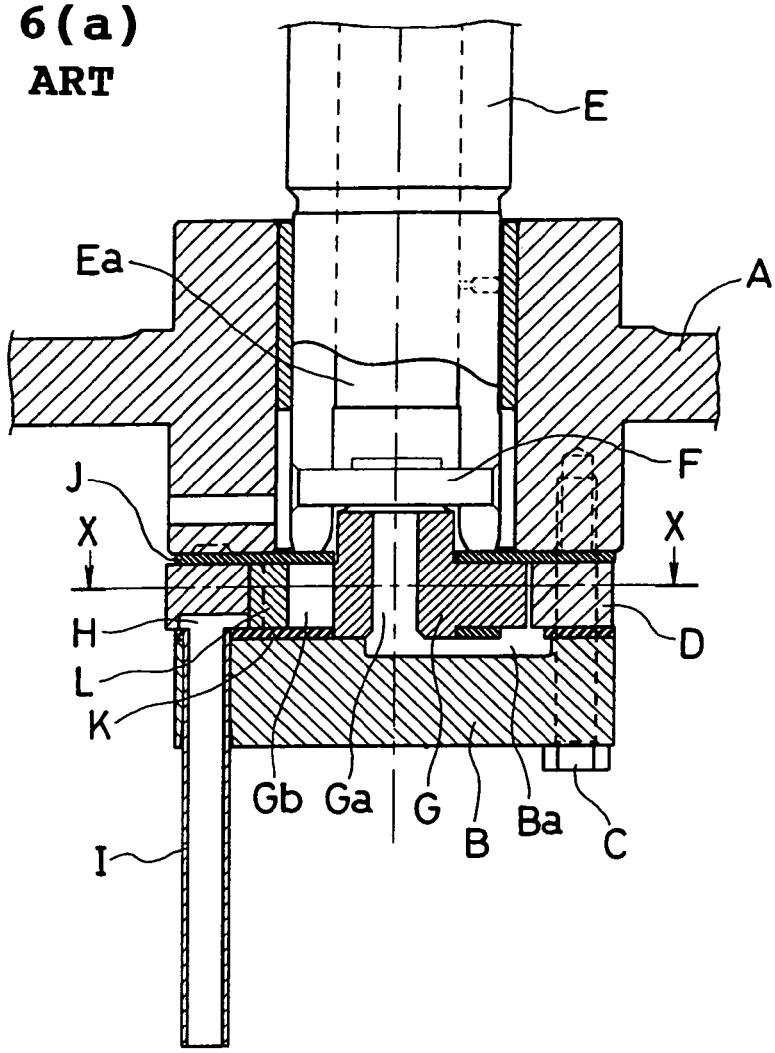
Fig. 6(a) PRIOR ART
FIG. 6 illustrates an example of prior art in (a) a brief cross-sectional view of the major part of an oil pump and (b) a brief horizontal cross-sectional view taken along X-X line.
Figure 6B:
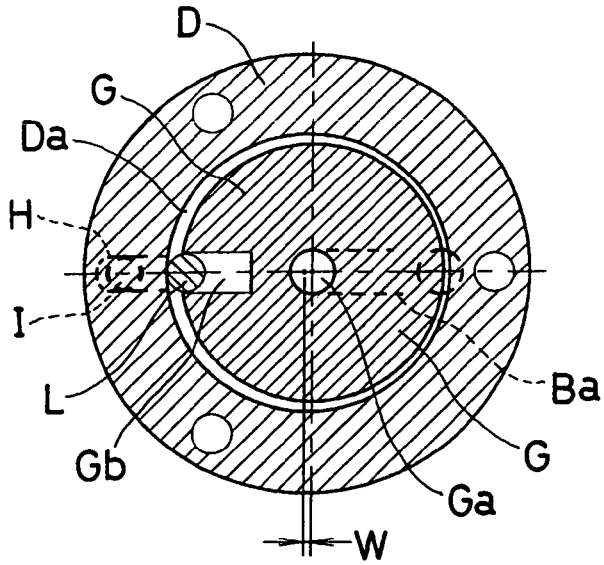
Fig. 6(b) PRIOR ART

The cylinder 18 of this oil pump 15 is provided with plates 22, 23 located in the upper and lower surfaces thereof to close the upper and lower surfaces of the inner space 18*a*. In addition, the cylinder is attached such that the center. of the inner space 18*a* is slightly deviated from the center of the rotator 19 to form an eccentric annular oil passage between the cylinder and the rotator 19 similar to FIG. 6(*b*). This oil passage is brought into communication with the communication notch 18*b* and a communication path 16*a* formed in the upper surface of the attachment member 16. The communication path 16*a* is brought into communication with a bore 19*a* formed through the center of the rotator 19. This through bore 19*a* is brought into communication with an oil passage 7*c* provided inside the driveshaft 7 along the axial line. A notch (not shown) is provided in the outer circumference of the rotator 19 similar to FIG.6(*b*). A columnar piston member (not shown) is slidably fitted in the notch.

In the oil pump 15 thus configured, when the driveshaft 7 rotates about the axis, the rotator 19 rotates within the inner space 18*a* of the cylinder 18. As a result, a suction force is caused in the communication notch 18*b* and it sucks up the oil from the oil storage 20 through the suction pipe 21. The oil sucked up through the suction pipe 21 flows from the upper end 21*a* of the suction pipe 21 into the communication notch 18*b* of the cylinder 18. It is then sucked from the communication notch 18*b* into the inner space 18*a* of the cylinder 18. The oil sucked in the inner space 18*a* is pushed away in response to the rotation of the piston member and it moves through the eccentric annular oil passage and flows into the communication path 16*a* of the attachment member 16. Then the oil moves upward from the communication path 16*a* along the inner wall of the through bore 19*a* in the rotator 19. It further moves upward along the inner wall of the oil passage 7*c* of the driveshaft 7 and is supplied from the oil passage 7*c* to the sliding portion of the compressive element 3 and the bearing portions 8*a*, 14*a* of the driveshaft 7.

The oil passage 7*c* in the driveshaft 7 has an upper end brought into communication with an oil passage 7*d* formed inside the eccentric cum 7*a* along the axis as shown in FIG. 1. This oil passage 7*d* is in communication with a plurality of oil supply holes 3*e* formed inside the swinging scroll 3*b*. The oil moved upward from the oil passage 7*d* of the eccentric cum 7*a* is supplied to the bearing 10 portion that bears the eccentric cum 7*a*. The oil led into the oil supply hole 3*e* of the swinging scroll 3*b* moves from the upper end of the oil supply hole 3*e* along the outer circumference of the swinging scroll 3*b* down to the lower surface. It is then supplied to the sliding surface between the swinging scroll 3*b* and the upper support frame 8.

A terminal 24 is attached to the upper portion of the sidewall of the container body 1. The terminal has an inner terminal connected to the stator 2*a* of the electric element 2 via an inner lead (not shown), and an outer terminal connected to a lead from an external power source (not shown). Thus, when power is supplied from the external power source, the electric element 2 can be operated through the terminal 24.

A suction pipe 25 is attached to a required location on the sidewall of the container body 1. The suction pipe 25 has an inner end connected to a suction port (not shown) of the compressive element 3 via a coupling pipe. The suction pipe 25 has an outer end connected to piping from a gas supply source (not shown). Thus, when a refrigerant gas is supplied from the suction pipe 25, the refrigerant gas is sucked from the suction port (not shown) of the compressive element 3 into the compression chamber, and compressed by turns of the swinging scroll 3*b*. The compressed refrigerant gas is discharged from the discharge port 3*c* of the fixed scroll 3*a*. It also flows in the upper spatial region via the recess 3*d* and the through hole 4*a* and is discharged from the discharge pipe 12 to external.

The scroll compressor according to the embodiment is configured as above and, when power is supplied from the external power source, the electric element 2 operates to rotate the rotor 2*b*. In response to the rotation of the rotor 2*b*, the driveshaft 7 rotates about the axis to turn the swinging scroll 3*b* of the compressive element 3 via the eccentric cum 7*a*. As a result, a gas such as a refrigerant gas supplied from the suction pipe 25 is sucked from the suction port of the compressive element 3 into the compression chamber to start running of compression.

During running of compression, the oil pump 15 sucks up oil from the oil storage 20 through the suction pipe 21. The oil flows from the communication notch 18*b* of the cylinder 18 into the inner eccentric annular oil passage as described above. It further flows through the communication path 16*a* of the attachment member 16 and the through bore 19*a* of the rotator 19 into the oil passage 7*c* of the driveshaft 7. The oil is supplied from the oil supply hole provided in the oil passage 7*c* to the bearing portion 14*a* of the lower support frame 14 and the bearing portion 8*a* of the upper support frame 8. The upper and lower ends of the driveshaft 7 are supported on the bearing portion 8*a* of the upper support frame 8 and the bearing portion 14*a*of the lower support frame 14, respectively. Accordingly, the rotation about the axis in response to the rotation of the rotor 2*b* is stabilized and an appropriate position of the rotor 2*b* can be retained relative to the stator 2*a*.

The oil led in the eccentric cum 7*a* of the driveshaft 7 is supplied to the bearing 10 portion that bears the swinging scroll 3*b* and to the sliding portion between the swinging scroll 3*b* and the upper support frame 8 as described above to lubricate these portions sufficiently.

When power supply to the electric element 2 is cut off to stop the compressor, the rotation of the driveshaft 7 about the axis and the operation of the oil pump also stop. On the stop of the compressor, the oil in the oil passage 7*c* of the driveshaft 7 and the oil passage 7*d* of the eccentric cum 7*a* loses the elevating force derived from the centrifugal force and moves downward along the respective inner wall. Under the pressure of the oil moving downward, the oil moves backward through the oil movement path in the oil pump 15 and returns through the suction pipe 21 to the oil storage 20. The oil supplied to the sliding portion of the swinging scroll 3*b* and to the bearing portions of the driveshaft 7 and the eccentric cum 7*a* partly drops and returns to the oil storage 20 as well.

In the oil pump 15 the upper end 21*a* of the suction pipe 21 is protruded into the communication notch 18*b* of the cylinder 18. Accordingly, during the return of oil, if the amount of return oil is large and the oil pressure is strong in the oil pump 15, the oil exceeds the upper end 21*a* of the suction pipe 21, flows into the suction pipe 21 and returns to the oil storage 20. To the contrary, if the amount of return oil is reduced and the oil pressure is weak in the oil pump 15, the oil can not exceed the upper end 21*a* of the suction pipe 21 to return to the oil storage 20. Thus, part of the return oil is forced to reside in the oil pump 15 at a lower level below the upper edge of the upper end 21*a* of the suction pipe 21. In this case, the upper end 21*a* of the suction pipe 21 is protruded into the communication notch 18*b* to configure the oil residue pool.

In this way, part of the return oil resides in the oil pump 15 when the compressor stops. Thus, the property of oil sealing the oil pump 15 can be retained and the oil supply performance of the oil pump 15 can be improved when the compressor restarts.

Figure 3:
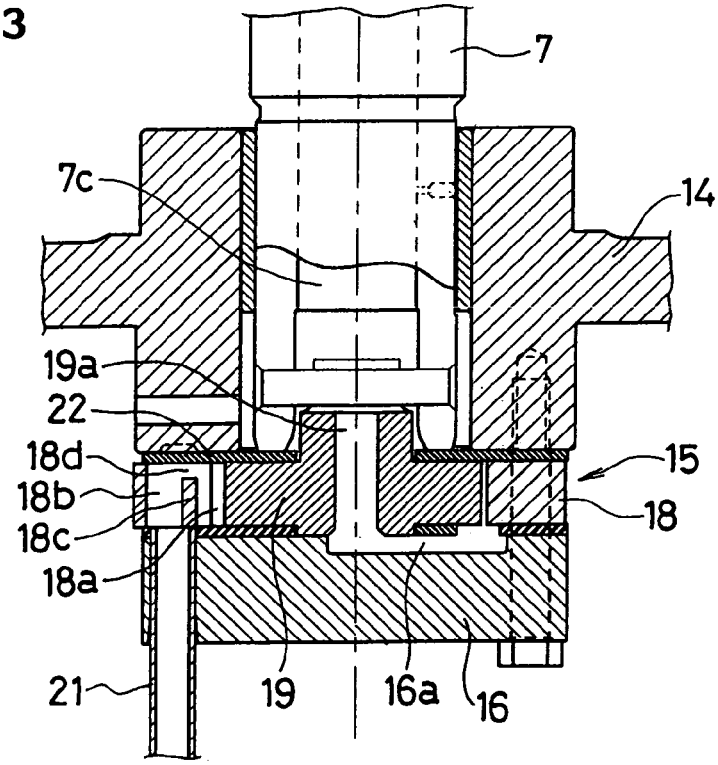
FIG. 3 is a brief cross-sectional view showing part of a second embodiment of the present invention applied to the scroll compressor.

FIG. 3 is a brief vertical cross-sectional view of the major part showing a second embodiment according to the present invention. In the second embodiment the same components as those in the first embodiment are denoted with the same reference numerals and omitted from the following detailed description.

The scroll compressor according to the second embodiment is same in basic structure as the scroll compressor according to the first embodiment but different in structure of the oil residue pool. In this case, a standing wall 18*c* is provided in the communication notch 18*b* formed by notching part of the cylinder 18, and a higher oil passage 18*d* is provided above the standing wall 18*c*. The oil passage at the suction pipe 21 is brought into communication with the oil passage at the inner space 18*a* of the cylinder 18 through the higher oil passage 18*d*.

The suction pipe 21 is attached such that the upper end thereof does not protrude into the communication notch 18*c* but rather the lower opening surface of the communication notch 18*c* and the upper end surface of the suction pipe 21 locate in the same horizontal plane. This is different in structure from the first embodiment.

In the second embodiment, the oil sucked up from the oil storage 20 flows from the upper end of the suction pipe 21 into the communication notch 18*b*. It also flows through the higher oil passage 18*d* above the standing wall 18*c* into the inner space 18*a* of the cylinder 18. The oil led in the inner space 18*a* of the cylinder 18 flows through the eccentric annular oil passage, the communication path 16*a* of the attachment member 16 and the through bore 19*a* of the rotator 19 into the oil passage 7*c* of the driveshaft 7. The oil is then supplied from the oil supply hole provided in the oil passage 7*c* to the bearing portion 14*a* of the lower support frame 14 and the bearing portion 8*a* of the upper support frame 8. The oil led in the eccentric cum 7*a* of the driveshaft 7 is supplied to the bearing 10 portion that bears the swinging scroll 3*b* and to the sliding portion between the swinging scroll 3*b* and the upper support frame 8 to lubricate these portions sufficiently.

When power supply to the electric element 2 is cut off to stop the compressor, the rotation of the driveshaft 7 about the axis and the operation of the oil pump 15 stop. On the stop of the compressor, the oil in the oil passage 7*c* of the driveshaft 7 and the oil passage 7*d* of the eccentric cum 7*a* loses the elevating force derived from the centrifugal force and moves downward along the respective inner wall. Under the pressure of the oil moving downward, the oil moves backward through the oil movement path in the oil pump 15 and returns through the suction pipe 21 to the oil storage 20. The oil supplied to the sliding portion of the swinging scroll 3*b* and to the bearing portions of the driveshaft 7 and the eccentric cum 7*a* partly drops and returns to the oil storage 20 as well.

In the oil pump 15 the standing wall 18*c* is provided in the communication notch 18*b* and the higher oil passage 18*d* is provided above the standing wall 18*c* as described above. Accordingly, during the return of oil, if the amount of return oil is large and the oil pressure is strong in the oil pump 15, the oil flows through the higher oil passage 18*d* into the suction pipe 21 and returns to the oil storage 20. To the contrary, if the amount of return oil is reduced and the oil pressure is weak in the oil pump 15, the oil is blocked at the standing wall 18*c*. Accordingly, it can not flow through the higher oil passage 18*d* into the oil passage of the suction pipe 21 to return to the oil storage 20. Thus, part of the return oil is forced to reside in the oil pump 15 at a lower level below the upper edge of the standing wall 18*c*. In this case, the standing wall 18*c* and the higher oil passage 18*d* above the wall configure the oil residue pool.

In this way, part of the return oil resides in the oil pump 15 when the compressor stops. Thus, the property of oil sealing the oil pump 15 can be retained and the oil supply performance of the oil pump 15 can be improved when the compressor restarts.

Figure 4:
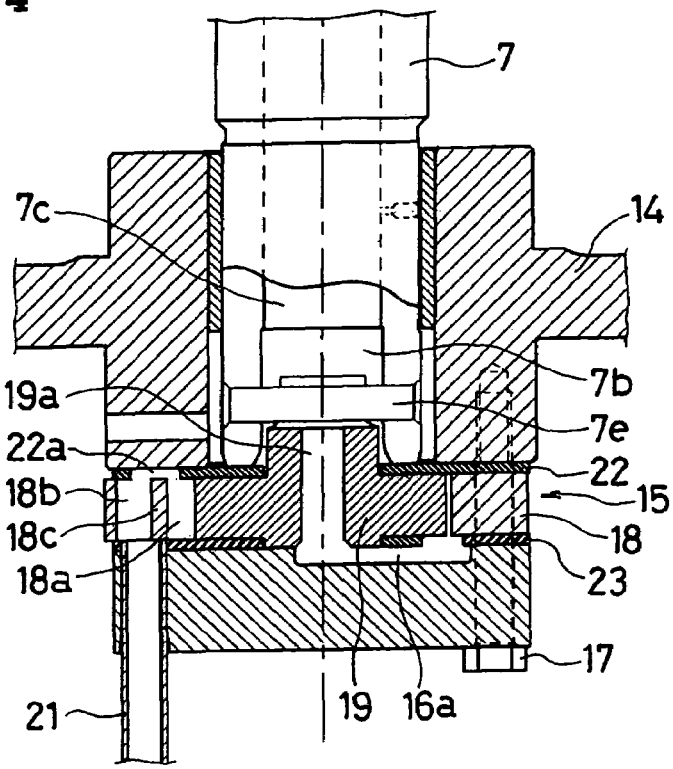
FIG. 4 is a brief cross-sectional view showing part of a third embodiment of the present invention applied to the scroll compressor.

FIG. 4 is a brief vertical cross-sectional view of the major part showing a third embodiment according to the present invention. In the third embodiment the same components as those in the first and second embodiments are denoted with the same reference numerals and omitted from the following detailed description.

The scroll compressor according to the third embodiment is same in basic structure as the scroll compressor according to the first embodiment but partly different in structure of the oil residue pool according to the second embodiment. In this case, a standing wall l8*c* having a height almost same as the height of the cylinder 18 is provided in the communication notch 18*b* formed by notching part of the cylinder 18. A higher oil passage 22*a* is formed by a through hole provided in the upper plate 22 located above the standing wall 18*c*. The oil passage at the suction pipe 21 is brought into communication with the oil passage at the inner space 18*a* of the cylinder 18 through the higher oil passage 22*a*. The through hole in the upper plate 22 that forms the higher oil passage 22*a* has an upper opening closed with the lower surface of the lower support frame 14.

In the third embodiment, the oil sucked up from the oil storage 20 flows from the upper end of the suction pipe 21 into the communication notch 18*b*. It also flows through the higher oil passage 22*a* above the standing wall 18*c* into the inner space 18*a* of the cylinder 18. The oil led in the inner space 18*a* of the cylinder 18 flows through the eccentric annular oil passage, the communication path 16*a* of the attachment member 16 and the through bore 19*a* of the rotator 19 into the oil passage 7*c* of the driveshaft 7. The oil is then supplied from the oil supply hole provided in the oil passage 7*c* to the bearing portion 14*a* of the lower support frame 14 and the bearing portion 8*a* of the upper support frame 8. The oil led in the eccentric cum 7*a* of the driveshaft 7 is supplied to the bearing 10 portion that bears the swinging scroll 3*b* and to the sliding portion between the swinging scroll 3*b* and the upper support frame 8 to lubricate these portions sufficiently.

When power supply to the electric element 2 is cut off to stop the compressor, the rotation of the driveshaft 7 about the axis and the operation of the oil pump 15 stop. On the stop of the compressor, the oil in the oil passage 7*c* of the driveshaft 7 and the oil passage 7*d* of the eccentric cum 7*a* loses the elevating force derived from the centrifugal force and moves downward along the respective inner wall. Under the pressure of the oil moving downward, the oil moves backward through the oil movement path in the oil pump 15 and returns through the suction pipe 21 to the oil storage 20. The oil supplied to the sliding portion of the swinging scroll 3*b* and to the bearing portions of the driveshaft 7 and the eccentric cum 7*a* partly drops and returns to the oil storage 20 as well.

In the oil pump 15 the standing wall 18*c* is provided in the communication notch 18*b* and the higher oil passage 22*a* is provided above the standing wall 18*c* described above. Accordingly, during the return of oil, if the amount of return oil is large and the oil pressure is strong in tile oil pump 15, the oil flows through the higher oil passage 22*a* into the suction pipe 21 and returns to the oil storage 20. To the contrary, if the amount of return oil is reduced and the oil pressure is weak in the oil pump 15, the oil is blocked at the: standing wall 18*c*. Accordingly, it can not flow through the higher oil passage 22*a* into the oil passage of the suction pipe 21 to return to the oil storage 20. Thus, part of the return oil is forced to reside in the oil pump 15 at a lower level below the upper edge of the standing wall 18*c*. In this case, the standing wall 18*c* and the higher oil passage 22*a* above the wall configure the oil residue pool.

In this way, part of the return oil resides in the oil pump 15 when the compressor stops. Thus, the property of oil sealing the oil pump 15 can be retained and the oil supply performance of the oil pump 15 can be improved when the compressor restarts.

Figure 5:
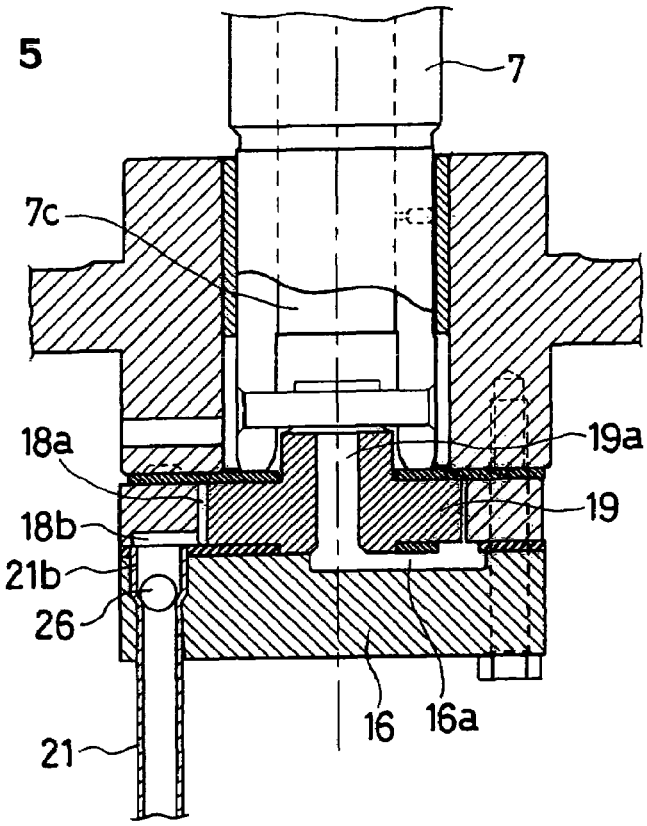
FIG. 5 is a brief cross-sectional view showing part of a fourth embodiment of the present invention applied to the scroll compressor.

FIG. 5 is a brief vertical cross-sectional view of the major part showing a fourth embodiment according to the present invention. In the fourth embodiment the same components as those in the first through third embodiments are denoted with the same reference numerals and omitted from the following detailed description.

The scroll compressor according to the fourth embodiment is same in basic structure as the scroll compressor according to the first embodiment but different in structure of the oil residue pool. In this case, an enlarged diameter portion 21*b* is provided via a step at the upper end of the suction pipe 21. A float 26 is housed in the enlarged diameter portion 21*b*. The lower opening surface of the communication notch 18*b* and the upper end surface of the suction pipe 21 are attached to each other to locate in the same horizontal plane. The step may be either a slanting step or a horizontal step.

The float 26 is formed in the shape of a sphere or hollow sphere having a diameter made smaller than the inner diameter of the enlarged diameter portion 21*b* of the suction pipe 21 and larger than the inner diameter of a portion below the step. The float 26 is operative to open/close the step of the suction pipe 21. On running, pushed up by the elevating force of the oil sucked up from the oil storage 20, the float 26 floats within the enlarged diameter portion 21*b* to open the step. As a result, the oil sucked up from the oil storage 20 flows from the upper end of the suction pipe 21 into the communication notch 18*b* and also flows into the inner space 18*a* of the cylinder 18. The oil led in the inner space 18*a* of the cylinder 18 flows through the eccentric annular oil passage, the communication path 16*a* of the attachment member 16 and the through bore 19*a* of the rotator 19 into the oil passage 7*c* of the driveshaft 7 similar to the above. The oil is then supplied from the oil supply hole provided in the oil passage 7*c* to the bearing portion 14*a* of the lower support frame 14 and the bearing portion 8*a* of the upper support frame 8. The oil led in the eccentric cum 7*a*of the driveshaft 7 is supplied to the bearing 10 portion that bears the swinging scroll 3*b* and to the sliding portion between the swinging scroll 3*b* and the upper support frame 8 to lubricate these portions sufficiently.

When power supply to the electric element 2 is cut off to stop the compressor, the rotation of the driveshaft 7 about the axis and the operation of the oil pump 15 stop. On the stop of the compressor, the oil in the oil passage 7*c* of the driveshaft 7 and the oil passage 7*d* of the eccentric cum 7*a* loses the elevating force derived from the centrifugal force and moves downward along the respective inner wall. Under the pressure of the oil moving downward, the oil moves backward through the oil movement path in the oil pump 15 and returns through the suction pipe 21 to the oil storage 20. The oil supplied to the sliding portion of the swinging scroll 3*b* and to the bearing portions of the driveshaft 7 and the eccentric cum 7*a* partly drops and returns to the oil storage 20 as well.

When the compressor stops, the float 26 moves down by the empty weight thereof to close the step in the suction pipe 21. During the return of oil, if the amount of return oil is large and the oil pressure is strong in the oil pump 15, the oil flowing down along the inner wall of the enlarged diameter portion 21*b* slightly pushes up the float 26. As a result, the step is opened partly or entirely to allow the oil to return to the oil storage 20. To the contrary, if the amount of return oil is reduced and the oil pressure is weak in the oil pump 15, it is impossible to push up the float 26 to open the step and the oil can not return to the oil storage 20. Thus, the return oil resides in the oil pump 15. In this case, the enlarged diameter portion 21*b* of the suction pipe 21 and the float housed therein configure the oil residue pool. If the float has a larger weight than required, an obstacle is caused when the oil is sucked up from the oil storage and the oil can not return when the compressor stops. Therefore, it is required to set an appropriate weight.

In this way, part of the return oil resides in the oil pump 15 when the compressor stops. Thus, the property of oil sealing the oil pump 15 can be retained and the oil supply performance of the oil pump 15 can be improved when the compressor restarts.

The first through fourth embodiments have been described as examples applied to the scroll compressor though the present invention is not limited to the scroll compressor but rather can be applied to compressors of other types.

The present invention is available in compressors of the type that includes an oil pump operative to suck up oil from an oil storage in the bottom. An oil residue pool is provided to allow part of oil returning to the oil storage to reside in the oil pump when the compressor stops, thereby improving the oil supply performance of the oil pump when the compressor restarts.

What is claimed is:

1. A compressor, comprising:

a container having a container body;

an electric element including a stator having an outer circumferential portion fixed on an inner wall of the container body and a rotor rotatably disposed on a central portion of the stator, and provided in the container;

a compressive element driven by the electric element;

an oil storage region in the bottom of the container;

an oil pump provided to suck up oil from the oil storage region, the oil pump including a cylinder fixed to a support frame attached in the container, a rotator attached to the lower end of a driveshaft axially installed on the rotor of the electric element and operative to rotate within an inner space of the cylinder, and a suction pipe having an upper end connected to a communication notch formed in the cylinder and a lower end inserted and arranged in the oil storage region; and an oil residue pool provided in the communication notch of the cylinder that is structured and arranged to retain some oil within the oil pump once the compressive element stops, wherein the oil residue pool is configured such that the upper end of the suction pipe is projected into and attached to the communication notch of the cylinder.

2. The compressor according to claim 1, wherein the oil residue pool is configured such that a standing wall is provided in the communication notch of the cylinder, and a higher oil passage is provided above the standing wall, wherein the oil passage at the suction pipe is brought into communication with the oil passage at the inner space of the cylinder through the higher oil passage.

3. The compressor according to claim 1, wherein the oil residue pool is configured such that the lower end of the communication notch of the cylinder is connected to the upper end of the suction pipe, wherein an enlarged diameter portion is provided at the upper end of the suction pipe, wherein a float is housed in the enlarged diameter portion.

* * * * *

UNITED STATES PATENT AND TRADEMARK OFFICE

CERTIFICATE OF CORRECTION

PATENT NO. : 7,442,018 B2
APPLICATION NO. : 11/523379
DATED : October 28, 2008
INVENTOR(S) : Yasunori Kiyokawa et al.

It is certified that error appears in the above-identified patent and that said Letters Patent is hereby corrected as shown below:

Column 5, line 28, “center.” should read --center--;

Column 6, line 50, “14aof” should read --14a of--;

Column 9, line 16, “tile oil” should read --the oil--;

Column 9, line 20, “the:” should read --the--; and

Column 10, line 1, “7aof” should read --7a of--.

Signed and Sealed this

Tenth Day of March, 2009

JOHN DOLL
*Acting Director of the United States Patent and Trademark Office*